United States Patent [19]

Ahn

[11] 4,388,995

[45] Jun. 21, 1983

[54] COLLAPSIBLE CONTAINER

[76] Inventor: Min H. Ahn, 5111 Maple Rd., Richmond, British Columbia, Canada

[21] Appl. No.: 271,472

[22] Filed: Jun. 8, 1981

[51] Int. Cl.[3] ..... B65D 6/18; B65J 1/02

[52] U.S. Cl. ..... 220/7; 220/1.5

[58] Field of Search ..... 220/1.5, 6, 7

[56] References Cited

U.S. PATENT DOCUMENTS

| | | | |
|---|---|---|---|
| 2,972,430 | 2/1961 | Johnson | 220/7 |
| 3,602,388 | 8/1971 | Hurkamp | 220/1.5 |
| 3,612,330 | 10/1971 | Baer | 220/1.5 |
| 3,765,556 | 10/1973 | Baer | 220/7 |
| 3,796,342 | 3/1974 | Sanders | 220/1.5 |
| 3,860,138 | 1/1975 | Lovich | 220/1.5 |
| 3,870,185 | 3/1975 | Sanders | 220/1.5 |
| 4,020,967 | 3/1977 | Hammond | 220/1.5 |
| 4,214,669 | 7/1980 | McQuiston | 220/1.5 |

*Primary Examiner*—George E. Lowrance

*Attorney, Agent, or Firm*—Townsend and Townsend

[57] ABSTRACT

A container able to be moved from a raised position to a folded position. The container has a base and a roof spaced. First members are pivotally attached to the base and extend upwardly when the container is raised. Second members are pivotally attached at one end to the roof and each pivotally attached at its other end to a first member. Upper side panels extend between the roof and a pair of second members. Lower side panels extend between the base and a pair of first members. Reciprocable locking members can move from a first position at which they lock the first and second members in the raised position to a second position in which they allow pivoting of the first and second members. The locking members may be moved as required.

10 Claims, 17 Drawing Figures

Fig. 4.
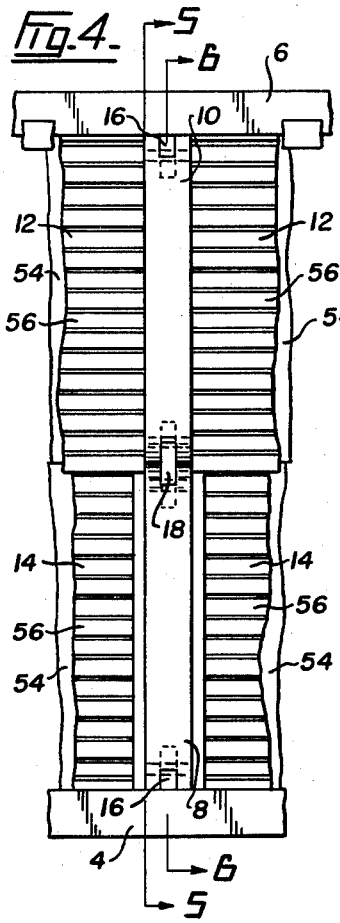
Fig. 5.
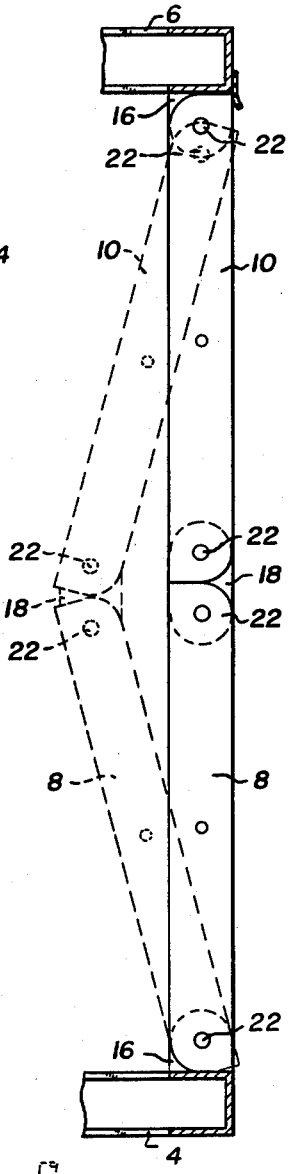
Fig. 6.
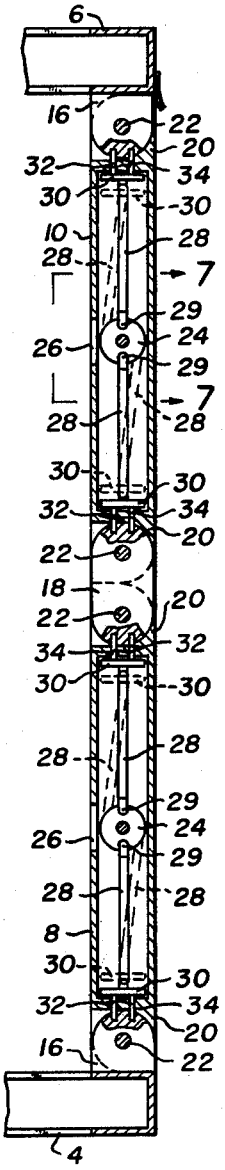
Fig. 7.
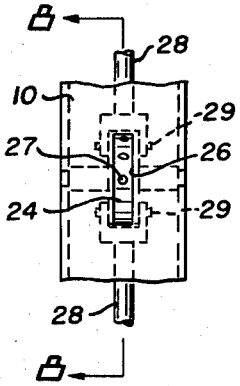
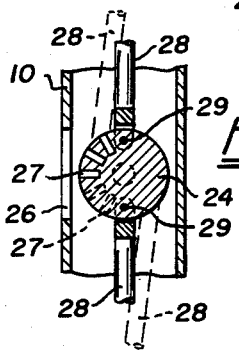
Fig. 8.

COLLAPSIBLE CONTAINER

FIELD OF THE INVENTION

This invention relates to a container able to be moved from a raised position to a folded position.

DESCRIPTION OF THE PRIOR ART

The use of containers in freight carriage is now widely practiced. The particular advantage of a container is that the cargo can be loaded at the factory and need not leave and container until its final destination. The container is moved from the factory, perhaps to a truck to be moved to the docks. The container is then moved by crane onto a ship. At the arrival port the container may be moved, still unopened, to a truck and delivered to its final destination. Only then need the container be opened. Particularly because of the simple shape of containers there is great savings in space in moving freight in addition to the advantages of moving freight in closed containers.

However, the containers are large and, when not in use, require a considerable amount of storage space. Furthermore, they offer a considerable wind resistance, particularly when a vehicle is empty. Cross winds can be dangerous against the large areas of the sides of unloaded containers.

SUMMARY OF THE INVENTION

The present invention seeks to avoid these disadvantages of containers by providing a container that is collapsible when not in use to form a simple flat bed.

Accordingly, in a first aspect, the present invention is a container able to be moved from a raised position to a folded position and comprising; a base; a roof spaced apart from the base; a plurality of first members pivotally attached to the base and extending upwardly when the container is raised; a plurality of second members pivotally attached at one end of the roof and each pivotally attached at its other end to a first member; upper side panels each extending between the roof and a pair of second members; lower side panels each extending between the base and a pair of first members; reciprocable locking members able to move from a first position at which they lock the first and second members in the raised position to a second position in which they allow pivoting of the first and second members; and means to move the locking members as required.

BRIEF DESCRIPTION OF THE DRAWINGS

Aspects of the invention are illustrated, merely by way of example, in the accompanying drawings in which:

FIG. 4 is a detail along the line 4—4 in FIG. 2.

FIG. 5 is a detail on the line 5—5 of FIG. 4;

FIG. 6 is a detail on the line 6—6 of FIG. 4;

FIG. 7 is a detail along the lines 7—7 of FIG. 6;

FIG. 8 is a detail along the line 8—8 of FIG. 7;

DESCRIPTION OF THE PREFERRED EMBODIMENTS

Figure 1:
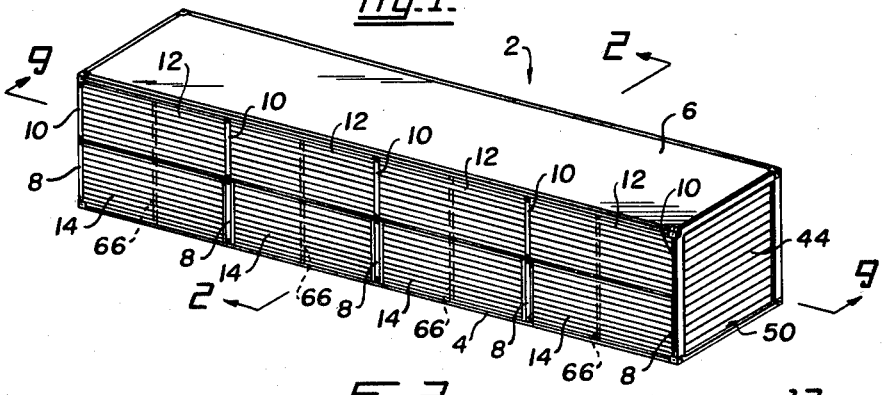
FIG. 1 is a general view of a container according to the present invention.
Figure 2:
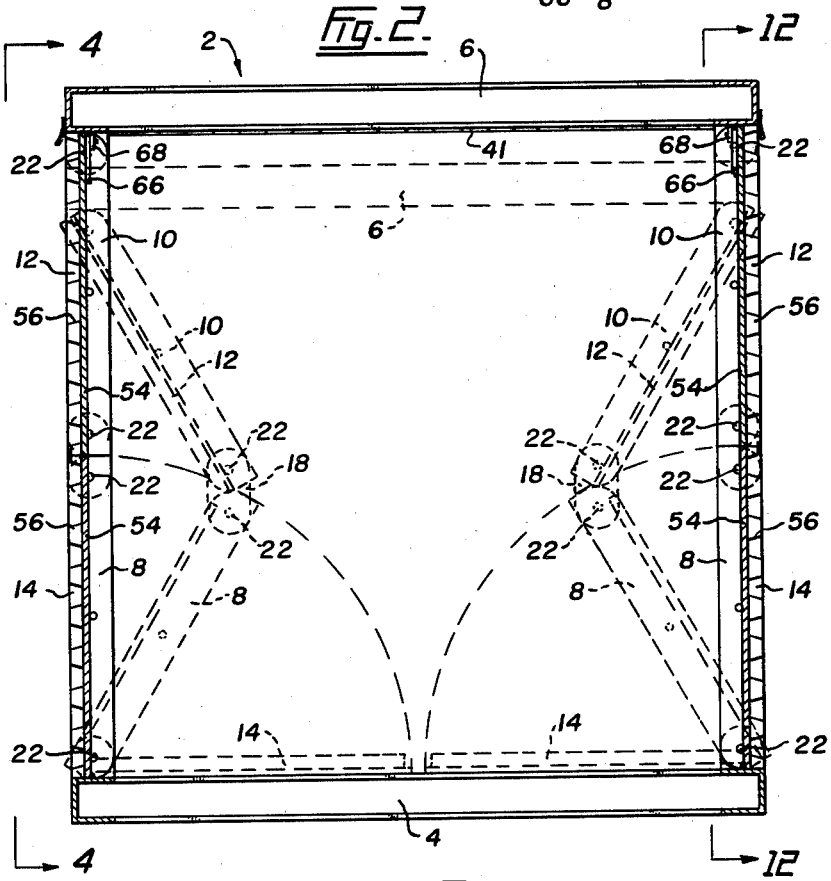
FIG. 2 is a detail on the line 2—2 in FIG. 1.
Figure 3:
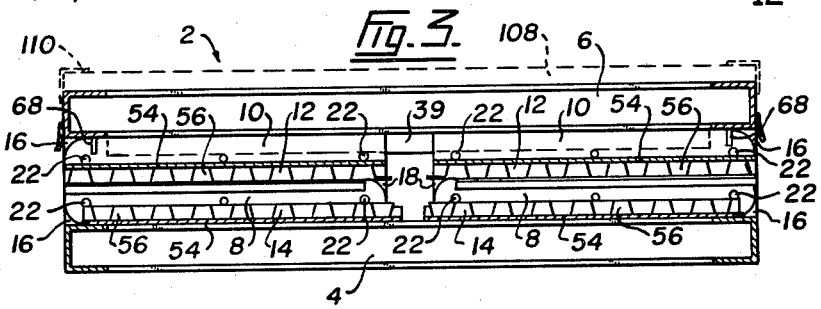
FIG. 3 is an end view of a container of FIG. 1, folded flat.

The drawings show a container 2 comprising a base 4 and a roof 6 spaced apart from the base 4. There are a plurality of first members 8 pivotally attached to the base 4 and extending upwardly when the container is raised, as shown in FIGS. 1 and 2. These first members 8 fold flat as shown in FIG. 3.

There are a plurality of second members 10 pivotally attached at one end to the roof 6 and each pivotally attached at its other end to a first member 8. There are upper side panels 12 each extending between the roof 6 and a pair of second members 10 and lower side panels 14 each extending between the base 4 and a pair of first members 8.

Pivotable joints between the first and second members 8 and 10 and between the first and second members in the roof or base respectively are illustrated in FIG. 6. Typically a tongue 16 extends downwardly from the roof 6 and upwardly from the base 4. In addition there is a plate member 18 positioned between adjoining first and second members 8 and 10. Each first and second member 8 and 10 is formed with spaced limbs 20 at each of its ends to engage a tongue 16 or plate member 18. A pivot pin 22 extends through aligned holes in the limbs 20 and in the tongue 16 or plate 18 and acts as a pivot point for the joint.

As particularly illustrated in FIGS. 6 to 8 the first and second members 8 and 10 are provided with locking systems so that they may be locked in a raised position. In the preferred embodiment illustrated the locking system comprises a cam 24 located within a first or second member and aligned with an opening 26 within that member. There are recesses 27 formed in the cam 24—see FIG. 8—so that a rod (not shown) may be inserted in a recess 27 in a cam 24 to pivot the cam 24. Rods 28 are pivotally attached at 29 to the cam and extend upwardly and downwardly towards the pivotable joints. At the ends of each rods 28 there is a plate member 30 formed with prongs 32. The top and bottom of the first and second members are formed with openings 34 through which the prongs 32 extend. The tongues 16 and plate members 18 are formed with recesses into which the prongs are inserted—see FIG. 6.

Figure 9:
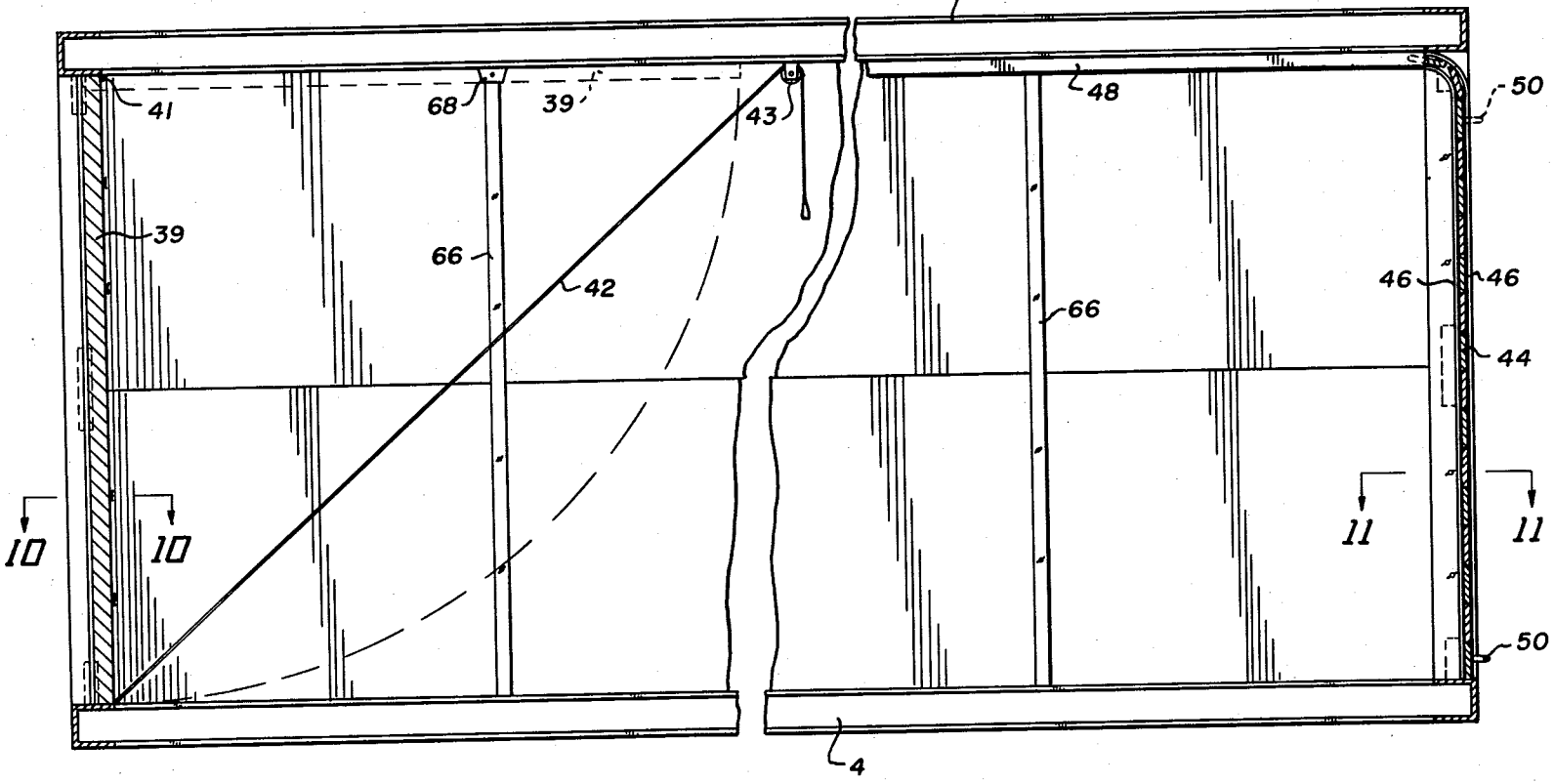
FIG. 9 is a view on the line 9—9 of FIG. 1.
Figure 10:
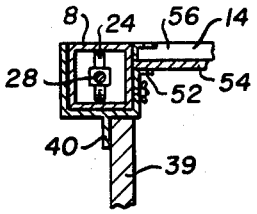
FIG. 10 is a detail on the line 10—10 of FIG. 9.
Figure 11:
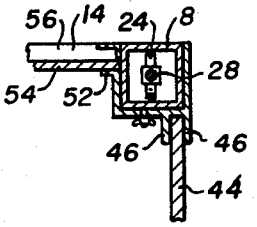
FIG. 11. is a detail on the line 11—11 of FIG. 9.

As illustrated in FIGS. 9 and 10 the container is desirably provided with a front comprising a panel 39 attached to flanges 40 formed in the leading first and second members 8 and 10. There is a hinge 41 at the top of the panel 39 and a line 42 extends around pulleys 43 so that the panel 39 may be moved by pulling on the line 42. Similarly it is desirable that there by an overhead door 44 running in a track formed by flanges 46—see FIG. 11—formed on the rear first and second members 8 and 10. Track members 48 are also formed in the rear of the roof 6 and the overhead door is then operated, for example, by handle 50 in conventional manner.

The panels 12 and 14 are located by the provision of flanges 52. In the case of the second members 10 the panels 12 are permanently located to the flanges 52. However, ever, the lower side panels 14 are detachably attached to the flanges 52 on the first members 8 by bolts or the like.

The panels 12 and 14 may, as shown in FIG. 2, simply comprise boards 54, for example of plywood to which metal corrugated members 56 may be attached. In the alternative shown in FIG. 15 the panels 12 and 14 are flexible members formed with corrugations 58. There is an arcuate member 60 at each end to engage on a flange 62 mounted either to the base 4 or the roof 6 and having a corresponding arcuate shape. In the center there are mutually engaging members 64 to locate the panel in the raised position.

Figure 12:
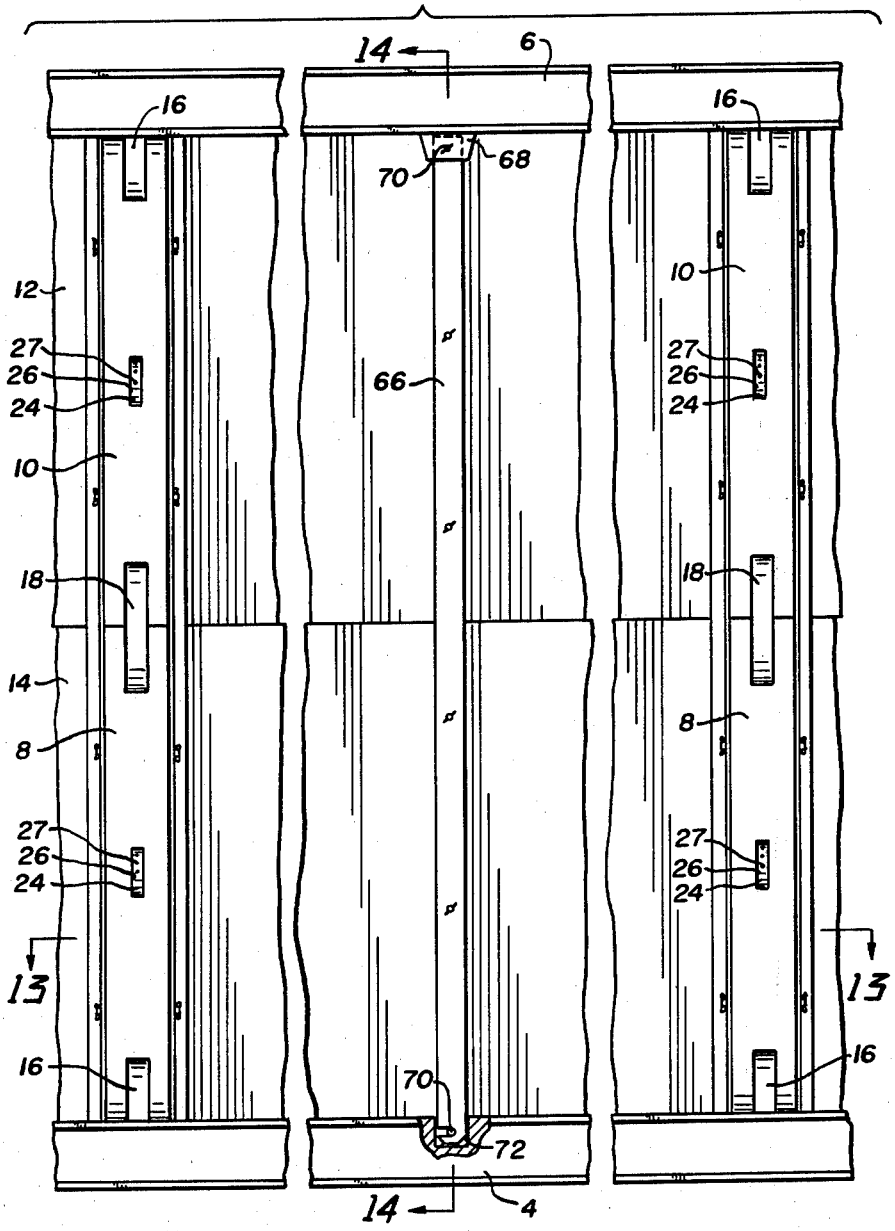
FIG. 12 is a detail on the line 12—12 of FIG. 2.
Figure 13:
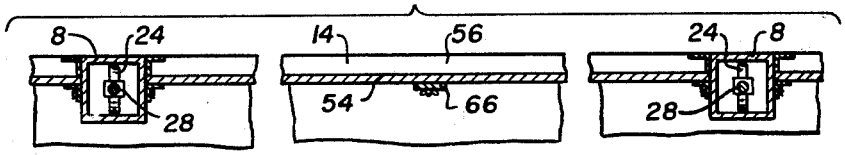
FIG. 13 is a detail on the line 13—13 of FIG. 12.
Figure 14:
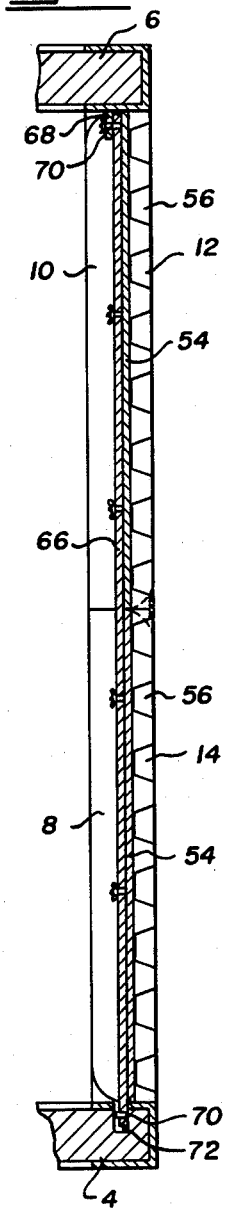
FIG. 14 is a detail along the line 14—14 in FIG. 12.

There are desirably bracing members 66 for the panels as shown in FIG. 12 between pairs of first and second members 8 and 10. The bracing members 66 may be received in sockets 68 attached to the roof 6. In the base they are attached pivotally to pins 70 mounted in recesses 72—see FIGS. 12 and 14.

To lower the container to the flat or folded position in the embodiments of FIGS. 1 to 14 the lower panels are first released from flanges 52. The lower panels are laid on the base 4. Panel 39 is raised to roof 6 and overhead door 44 opened. A crane or the like grips roof 6 and cams 24 are rotated to release prongs 32 from the recesses in tongues 16 and plates 18.

The roof is then lowered by the crane. The sides follow the path shown in broken lines in FIG. 2. To raise the container the roof is first raised, the cams rotated to extend prongs 32 to engage and lock tonques 16 and plates 18 and the panel 39 and door 44 may be moved. Lower members 14 are raised against flanges 52 and bolted or otherwise located in position.

Figure 15:
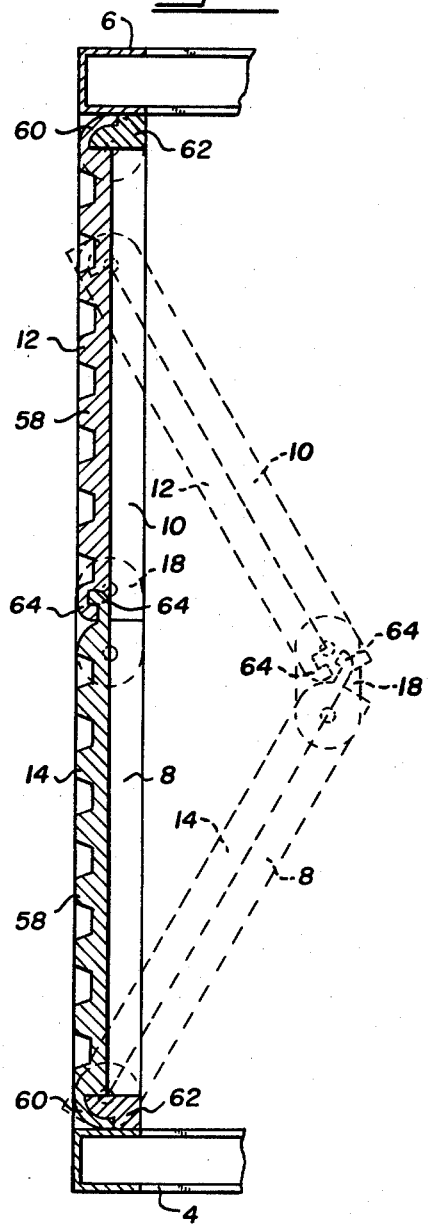
FIG. 15 illustrates one form of side panelling.
Figure 16:
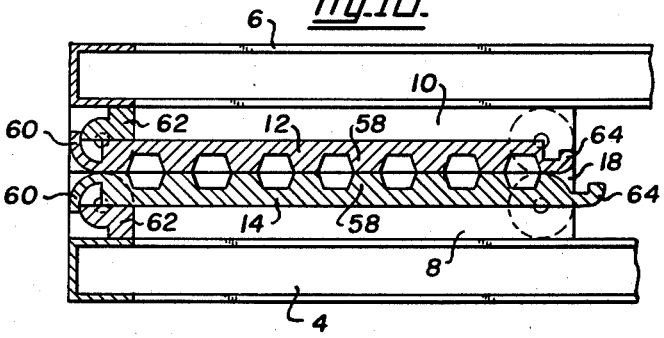
FIG. 16 illustrates the panelling of FIG. 15 folded.

With the embodiment of FIGS. 15 and 16 the above procedure applies but it is not necessary to move the lower panels first. They remain attached to members 8.

Figure 17:
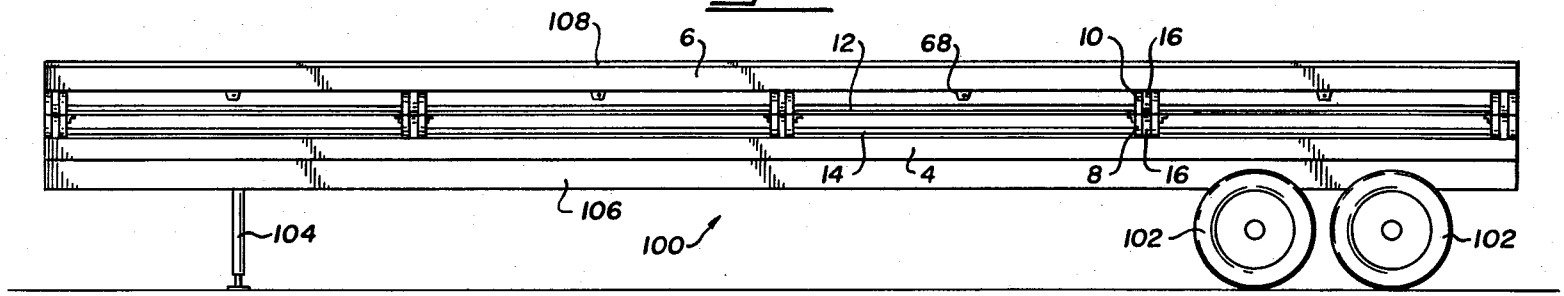
FIG. 17 illustrates the folded container used as a flat bed.

The container has a further advantage that when folded flat it can be used as a flat bed on a conventional trailer, for example the trailer used to haul the container when raised. This is shown in FIG. 17 where a trailer 100 is shown having wheels 102, a stand 104, and a chassis 106. A wooden top 108 in (see also FIG. 3) is also present to protect the roof 6. Top 108 may be protected by angle 110, on its edges.

I claim:

1. A container able to be moved from a raised position to a folded position and comprising:

a base;

a roof spaced apart from the base;

a plurality of first members pivotally attached to the base and extending upwardly when the container is raised;

a plurality of second members pivotally attached at one end to the roof and each pivotally attached at its other end to a first member;

upper side panels each extending between the roof and a pair of second members;

a cam pivotally mounted within each first and second member;

rods extending from each cam towards the roof and base respectively;

locking means attached to each rod and extendable to engage each pivotal joint whereby pivoting of the joint is prevented; and rotation of the cam retracting the locking means so that they do not engage the pivotal joint whereby the joints are free to pivot.

2. A container as claimed in claim 1 including bracing members for the panels between and generally parallel to the first and second members.

3. A container as claimed in claim 1 in which the first and second members at the leading corners of the container have flanges extending towards each other;

an end panel attached to said flanges to close an end of the container.

4. A container as claimed in claim 1 in which the first and second members at one end of the container each have two flanges, the flanges on each member extending towards the other member to define tracks;

tracks formed on the rear of the roof to align with the tracks formed on the first and second members at said one end; and an overhead door movable in said tracks from a closed to an open position.

5. A container as claimed in claim 1 in which the pivotal joint at the roof and base each comprise a tongue projecting from the roof or the base;

spaced limbs formed at the end of each first and second member to extend around a tongue; and a pivot pin extending through the limbs and the tongue to form the pivot joint.

6. A container as claimed in claim 1 in which the first and second members have spaced limbs where they meet;

a plate receivable between the two pairs of spaced limbs;

two pivot pins, each extending through one pair of limbs on a first member or a second and through a corresponding hole in the plate.

7. A container as claimed in claim 2 in which rods extend from each cam towards the adjacent ends of the first and second members;

locking means attached to each rod and extendable to engage the plate between the first and second members whereby pivoting of the joint is prevented, rotation of the cam acting to retract the locking means to permit rotation of the central joint.

8. A container as claimed in claim 1 in which the cam is provided with recesses;

an opening formed in the first or second member containing the cam through which a rod may be inserted to engage in the recess to turn the cam;

openings formed at the ends of each first and second member;

pegs attached to each rod and extendable through the opening;

recesses formed in the tongue member into which the rods can engage to lock the joints and prevent each joint from pivoting.

9. A container as claimed in claim 1 including flanges attached to the outer edge of the first members whereby the panels may be detachably attached to the first members to facilitate folding of the container.

10. A container as claimed in claim 1 in which the panels comprise flexible members having arcuate recesses at each end and adapted to engage a similar member at its middle;

lugs attached to the base and to the ceiling to engage correspondingly shaped recesses in the outer ends of the panel.

* * * * *